US008139093B2

(12) United States Patent
Koyabu et al.

(10) Patent No.: US 8,139,093 B2
(45) Date of Patent: Mar. 20, 2012

(54) THERMAL PRINTER

(75) Inventors: Akira Koyabu, Nagano-ken (JP); Toru Takami, Nagano-ken (JP); Sadao Murata, Nagano-ken (JP); Hitoshi Ishino, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 684 days.

(21) Appl. No.: 12/237,125

(22) Filed: Sep. 24, 2008

(65) Prior Publication Data

US 2009/0086006 A1 Apr. 2, 2009

(30) Foreign Application Priority Data

Sep. 28, 2007 (JP) ..... 2007-254266

(51) Int. Cl.
*B41J 25/304* (2006.01)

(52) U.S. Cl. ..... 347/197

(58) Field of Classification Search ..... None
See application file for complete search history.

(56) References Cited

U.S. PATENT DOCUMENTS

| | | | | |
|---|---|---|---|---|
| 5,806,999 | A | 9/1998 | Kobayashi | |
| 5,886,726 | A * | 3/1999 | Pawelka et al. | 347/197 |
| 5,961,228 | A | 10/1999 | Ward et al. | |
| 6,784,906 | B2 | 8/2004 | Long et al. | |
| 7,710,442 | B2 * | 5/2010 | Lyons et al. | 347/171 |
| 2008/0003038 | A1 | 1/2008 | Nihashi et al. | |

FOREIGN PATENT DOCUMENTS

| | | |
|---|---|---|
| JP | 03051149 | 3/1991 |
| JP | 05050703 | 3/1993 |
| JP | 2000052614 | 2/2000 |
| JP | 2007320121 | 12/2007 |
| WO | 2004058508 A2 | 7/2004 |

* cited by examiner

*Primary Examiner* — Julian Huffman
*Assistant Examiner* — Alexander C Witkowski
(74) *Attorney, Agent, or Firm* — Mark P. Watson

(57) ABSTRACT

A thermal printer enables both duplex printing and simplex printing. A double-sided thermal printer 1 has a first arm 31 and a second arm 32 that opens and closes in conjunction with the first arm 31. A first platen roller 21 is mounted on the first arm 31, a second thermal print head 12 is mounted on the second arm 32, and a first thermal print head 11 and second platen roller 22 are disposed on the printer frame 30 side. When the operating cover 3 closes, the second thermal print head 12 on the second arm 32 is pressed against the second platen roller 22, the first platen roller 21 on the first arm 31 is pressed to the first thermal print head 11, and the double-sided thermal paper 6 can be set with no slack. For simplex printing, the paper transportation load can be reduced by pressing only the first platen roller 21 on the first arm to the first thermal print head 11.

11 Claims, 5 Drawing Sheets

THERMAL PRINTER

CROSS-REFERENCE TO RELATED APPLICATIONS

Japanese Patent application No. 2007-254266 is hereby incorporated by reference in its entirety.

BACKGROUND

1. Field of Invention

The present invention relates to a thermal printer having two thermal print head and platen roller sets disposed along the thermal paper transportation path for printing on both the front and back sides of double-sided thermal paper.

2. Description of Related Art

A thermal printer that prints on double-sided thermal paper having thermo-sensitive surfaces formed on both sides of the paper is disclosed in U.S. Pat. No. 6,784,906. The disclosed thermal printer has a first print head and first platen supported on a first arm and a second platen opposing the first print head and a second print head opposing the first platen supported on a second arm installed on the printer frame side. When roll paper is pulled from a roll of double-sided thermal paper and the first arm is closed to the second arm, the double-sided thermal paper is set between the first print head and second platen on the upstream side of the paper transportation direction and between the second print head and the first platen on the downstream side in the transportation direction, the first print head opposes the front side of the double-sided thermal paper, and the second print head opposes the back side of the double-sided thermal paper. The front and back sides of the double-sided thermal paper can therefore be printed simultaneously.

However, the thermal printer disclosed in U.S. Pat. No. 6,784,906 fails to solve the following problems.

First, when the first arm closes to the second arm, the first print head and first platen carried on the first arm are simultaneously pressed to the respectively opposing second platen and second print head. As a result, even if the first arm is closed while pulling on the double-sided thermal paper so that there is no slack, the first and second platens which are free at this time may rotate due to the tension of the double-sided thermal paper because the double-sided thermal paper is simultaneously held between the first print head and the second platen on the upstream side and the second print head and first platen on the downstream side, and slack results easily between the first and second platens. If slack develops, the double-sided thermal paper may become skewed while being conveyed. An operation to remove the slack is therefore necessary.

Second, the first print head and first platen on the first arm must be positioned to contact the second platen and second print head on the second arm during printer assembly, for example. This requires simultaneously positioning the two print head and platen sets, which makes positioning more difficult than when the first print head is positioned to the second platen and the first platen is separately and independently positioned to the second print head.

Third, because there are two sets of print heads and platens, repulsion to the pressure applied to press the first print head to the second platen and repulsion to the pressure applied to press the second print head to the first platen both work when the first arm closes. This requires applying twice as much force to the first arm as when there is only one print head and platen set and a single print head is pressed to the platen. A strong operating force is therefore required to overcome twice the repulsion force when closing the first arm, and the first arm can be easily deformed by this strong operating force. When the cover to which the first arm is attached is closed to the printer frame side and an assembly that latches at both widthwise sides are used, deformation of the first arm when the cover closes can result in only one side engaging in the closed position and the other side not completely engaging in the closed position. The possibility is therefore high that the cover may be latched on only one side.

Fourth, because two sets of print heads are always pressed against the opposing platens when the first arm is closed, the paper transportation load on the double-sided thermal paper passing therebetween is increased. Two sets of print heads are also always pressed against the double-sided thermal paper in the same way as when both sides are printed even if only one side of the paper is printed using one print head similarly to when single-sided thermal paper having a thermo-sensitive coating rendered on only one side of the thermal paper is printed. This creates the problem that printing in a manner that is optimal for printing on only one side is not possible.

SUMMARY OF INVENTION

The thermal printer according to at least one embodiment of the invention solves the foregoing problems of the conventional thermal printer having two thermal print head and platen roller sets for printing on both sides of the printing media.

A first aspect of at least one embodiment of the invention is a thermal printer including: a first thermal print head; a first platen roller; a second thermal print head; a second platen roller; a printer frame on which the first thermal print head and second platen roller are mounted; a first arm on which the first platen roller is mounted and which can move between a first closed position where the first platen roller is pressed to the first thermal print head, and a first open position where the first platen roller is separated from the first thermal print head; and a second arm on which the second thermal print head is mounted and which can move between a second closed position where the second thermal print head is pressed to the second platen roller and a second open position where the second thermal print head is separated from the second platen roller.

A second aspect of at least one embodiment of the invention is a thermal printer including: a first thermal print head; a first platen roller; a second thermal print head; a second platen roller; a printer frame on which the first platen roller and second thermal print head are mounted; a first arm on which the first thermal print head is mounted and which can move between a first closed position where the first thermal print head is pressed to the first platen roller, and a first open position where the first thermal print head is separated from the first platen roller; and a second arm on which the second platen roller is mounted and which can move between a second closed position where the second platen roller is pressed to the second thermal print head and a second open position where the second platen roller is separated from the second thermal print head.

A thermal printer according to at least one embodiment of the invention has a first platen roller or first thermal print head mounted on a first arm, and a second thermal print head or second platen roller mounted on a second arm. Two thermal print head and platen roller sets can be opened and closed by opening and closing these two arms. Positioning the parts is therefore simpler and more precise than a configuration in which one of the parts for two thermal print head and platen roller sets are mounted on a single arm. In addition, because little force is applied to each arm when closing the arms, the arms are prevented from latching closed on only one side.

In a thermal printer according to another aspect of at least one embodiment of the invention, the second arm moves from the second open position to the second closed position when the first arm moves form the first open position to the first closed position; and the second arm moves from the second closed position to the second open position when the first arm moves from the first closed position to the first open position.

By thus opening and closing the second arm in conjunction with the first arm, a construction having two arms can be operated in the same way as a construction having one arm.

In a thermal printer according to another aspect of at least one embodiment of the invention, the second arm reaches the second closed position before the first arm reaches the first closed position when the first arm moves from the first open position to the first closed position.

If the second arm on which the second thermal print head or the second platen roller located on the upstream side in the thermal paper transportation path reaches the closed position first, the thermal paper can be prevented from being held with slack between the two thermal print head and platen roller sets. If the first arm is closed while pulling the thermal paper to the downstream side in the transportation direction, for example, the second arm will close first and hold the thermal paper between the upstream thermal print head and platen roller so that when the first arm then closes while tension is applied to the thermal print head leader, the thermal paper will be held between the downstream side thermal print head and platen roller with no slack in the paper. The thermal paper can therefore be loaded for printing with no slack. A paper feed operation for removing slack is therefore not necessary, and the thermal paper can be conveyed without skewing caused by slack.

In a thermal printer according to another aspect of at least one embodiment of the invention, the second arm can be set so that the second arm does not reach the second closed position even if the first arm moves to the first closed position. Alternatively, the second platen roller can be moved to a position where it will not contact the second thermal print head.

If the second arm can be set so that it will not reach the second closed position regardless of the position of the first arm when printing on only one side of the thermal paper using only the first thermal print head and first platen roller mounted on the first arm and printer frame, the thermal paper will not be held with the predetermined pressure between the second thermal print head and second platen roller that are not being used. If the second platen roller is moved to the retracted position so that it does not contact the second thermal print head, the thermal paper will also not be held therebetween with the predetermined pressure. Unnecessary paper transportation load can therefore be reduced and high speed printing can be enabled.

In a thermal printer according to another aspect of at least one embodiment of the invention, the second arm is removably attached to the printer frame or the first arm.

This configuration enables reconfiguring the thermal printer for single-sided printing by removing the second arm.

Further preferably, the thermal printer according to another aspect of at least one embodiment of the invention also has a roll paper compartment for storing roll paper having a long web of roll paper wound in a roll, and an operating cover that opens and closes to the roll paper compartment, and the operating cover is attached to the first arm.

In a thermal printer according to another aspect of at least one embodiment of the invention, the first arm and the second arm pivot on the same pivot shaft attached to the printer frame.

Alternatively, the first arm pivots on a first pivot shaft attached to the printer frame, and the second arm pivots on a second pivot shaft that is attached parallel to the first pivot shaft on the printer frame at a position that is different from the first pivot shaft.

Further alternatively, the first arm pivots on a first pivot shaft attached to the printer frame, and the second arm pivots on a second pivot shaft attached to the first arm parallel to the first pivot shaft.

Further preferably, a lock mechanism is disposed between the printer frame and at least one of the first arm and second arm. Because this lock mechanism can be engaged with less force than is required in a single arm configuration, latching on only one side can be prevented and the lock can be positively engaged.

As described above, a thermal printer according to at least one embodiment of the invention has a first arm and a second arm connected to the printer frame, either the first thermal print head or the first platen roller is mounted on the first arm and the other is disposed to the printer frame, and either the second thermal print head or the second platen roller is mounted on the second arm and the other is disposed to the printer frame. Therefore, when the first arm is closed, the first thermal print head and first platen roller are pressed together, and when the second arm is closed, the second thermal print head and second platen roller are pressed together. Two arms are thus used to open and close two thermal print head and platen roller sets.

As a result, the problems that occur with the thermal printer according to the related art, including the slack in the thermal paper that occurs in a conventional double-sided thermal printer having a single arm whereby two thermal print head and platen roller sets are simultaneously closed when the arm is closed, the difficulty positioning the thermal print heads and platen rollers, and latching only one side of the arm, do not occur.

The double-sided thermal printer according to at least one embodiment of the invention can also be easily configured for double-sided or duplex printing and single-sided or simplex printing.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of a thermal printer according to at least one embodiment of the invention are described below with reference to the accompanying figures.

Figure 1:
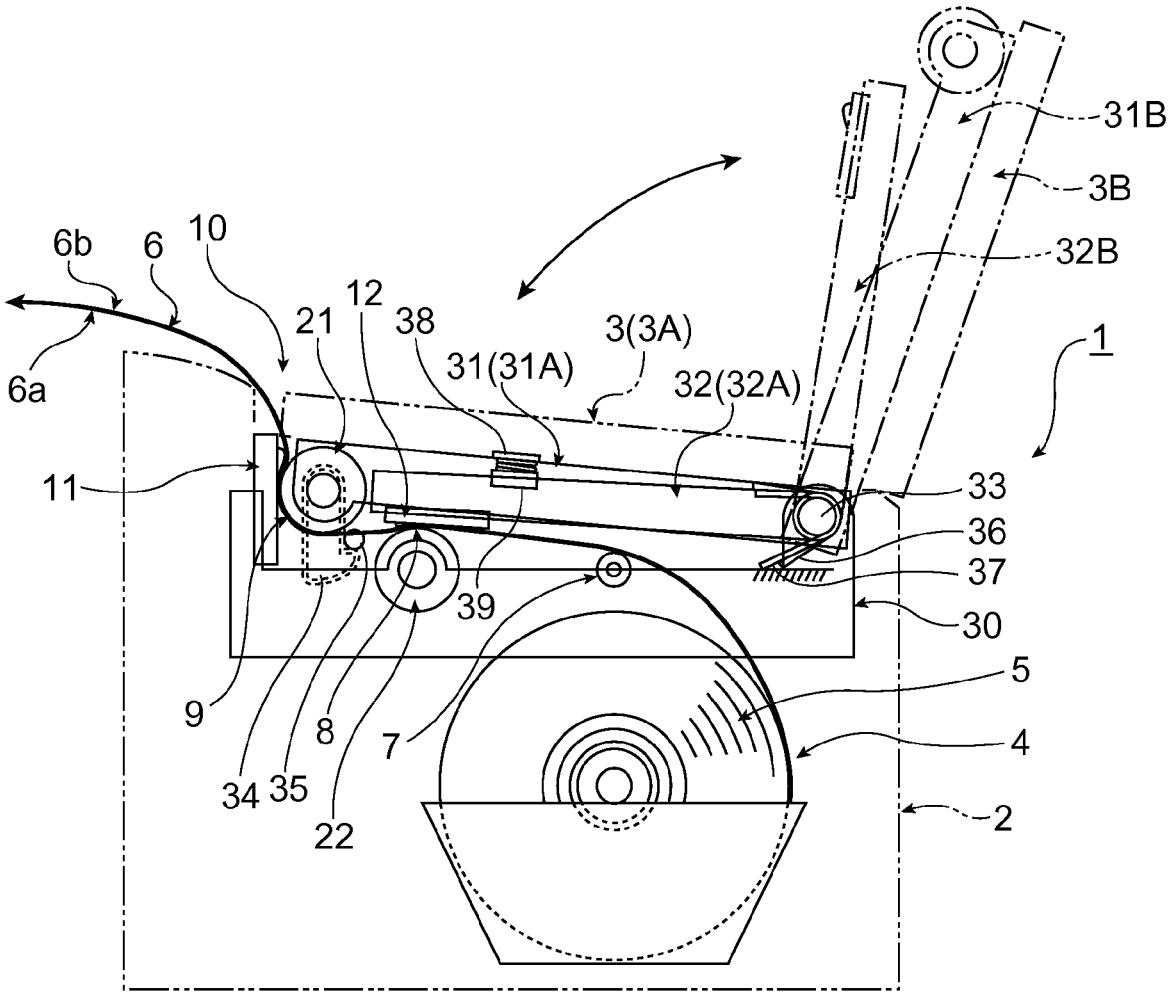
FIG. 1 shows a double-sided thermal printer according to at least one embodiment of the invention.
Figure 2:
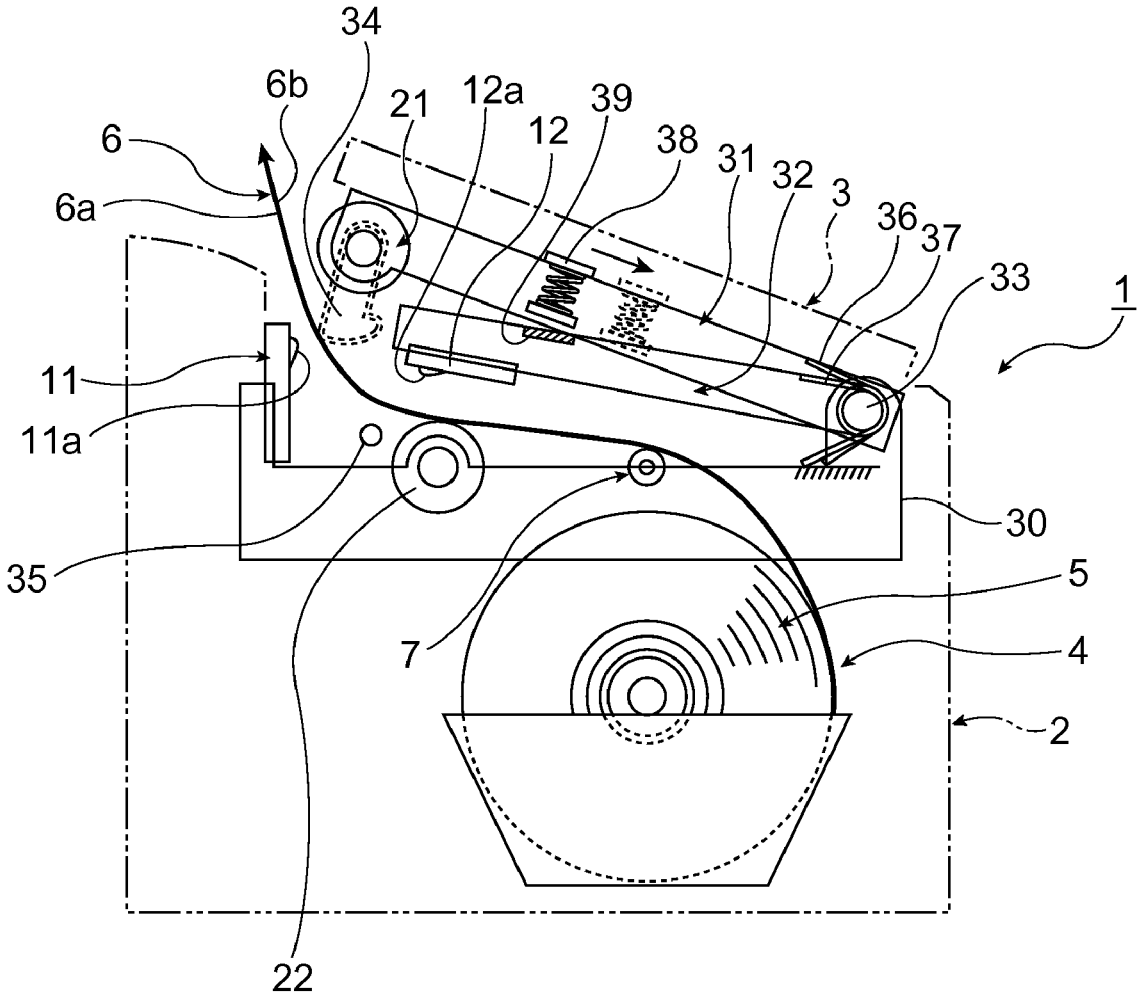
FIG. 2 shows the double-sided thermal printer shown in FIG. 1 when the operating cover is slightly open.

FIG. 1 describes a double-sided thermal printer according to a preferred embodiment of at least one embodiment of the invention, and FIG. 2 shows the double-sided thermal printer when the operating cover is slightly open.

The double-sided thermal printer 1 has a basically rectangular box-shaped printer case 2, and an operating cover 3 that is attached to open and close to this printer case 2. The operating cover 3 can open and close between a substantially horizontal closed position 3A and an open position 3B where the operating cover 3 is standing up as indicated by the double-dot dash line in FIG. 1.

When the operating cover 3 is open, the top end part of the roll paper storage compartment 4 formed inside the printer case 2 is open, and roll paper 5 can be loaded from above into the roll paper storage compartment 4. The roll paper 5 is a long web of thermal paper 6 wound into a roll. The roll paper 6 is, for example, double-sided thermal paper having thermo-sensitive surfaces 6*a* and 6*b* formed on the front and back sides.

The thermal paper 6 is pulled up and off the roll paper 5 held in the roll paper storage compartment 4, passed the guide roller 7 and guided horizontally toward the front of the printer, and set pulled out from the paper exit 10 passed a back-side printing position 8 and a front-side printing position 9.

A first thermal print head 11 and a first platen roller 21 are disposed at the front-side printing position 9. The thermal paper 6 is conveyed by the first platen roller 21 with the thermo-sensitive surface 6*a* on the front side pressed by the first platen roller 21 to the heat emitting surface 11*a* of the first thermal print head 11 for printing on this front thermo-sensitive surface 6*a*.

A second thermal print head 12 and second platen roller 22 are disposed to the back-side printing position 8. The thermal paper 6 is conveyed by the second platen roller 22 with the thermo-sensitive surface 6*b* on the back side pressed by the second platen roller 22 to the heat emitting surface 12*a* of the second thermal print head 12 for printing on this back thermo-sensitive surface 6*b*.

The first thermal print head 11, second platen roller 22, and guide roller 7 are disposed to the printer frame 30. The first platen roller 21 is disposed to a pivoting first arm 31 that is attached to the operating cover 3. The second thermal print head 12 is disposed to a second arm 32 that pivots in conjunction with the first arm 31.

The base end part of the first arm 31 is supported rotatably on a horizontal shaft 33 that is attached to the printer frame 30 and extends horizontally widthwise to the printer. The first arm 31 can thus pivot on this horizontal shaft 33 from the substantially horizontal closed position 31A (first closed position) to the open position 31B (first open position) indicated by the double-dot dash line in FIG. 1. The first platen roller 21 is disposed horizontally widthwise to the printer at a position on the underside of the distal end part of the first arm 31.

The first thermal print head 11 is attached at a position on the printer frame 30 side that is opposite the first platen roller 21 when the first arm 31 is closed. The first thermal print head 11 is disposed so that the heat emitting surface 11*a* is vertical and the first platen roller 21 is pressed to the heat emitting surface 11*a* with a predetermined amount of pressure when the first arm 31 is closed. The paper transportation force can be increased when the winding angle of the thermal paper 6 around the first platen roller 21 is thus large.

The trailing end part of the second arm 32 is similarly supported rotatably on a horizontal shaft 33, and can pivot on this horizontal shaft 33 from a substantially horizontal closed position 32A (second closed position) to the open position 32B (second open position) indicated by the double-dot dash line in FIG. 1. The second thermal print head 12 is disposed horizontally widthwise to the printer at a position on the underside of the distal end part of the second arm 32 with the heat-emitting surface 12*a* of the second thermal print head 12 facing down.

The second platen roller 22 is attached horizontally widthwise to the printer at a position on the printer frame 30 that is opposite the heat-emitting surface 12*a* of the second thermal print head 12 when the second arm 32 is closed. When the second arm 32 is closed, the heat-emitting surface 12*a* of the second thermal print head 12 is pressed against the second platen roller 22 with a predetermined amount of pressure.

A latch mechanism that locks the operating cover 3 in the closed position is rendered between the first platen roller 21 and the printer frame 30. The latch mechanism has left and right locking levers 34 and left and right catch pins 35. The locking levers 34 are attached at both sides on the distal end part of the first arm 31 with an urging force applied thereto by a spring, and the catch pins 35 are affixed on the printer frame 30 side. When the first arm 31 is open and pushed to the closed position 31A, the left and right locking levers 34 meet the left and right catch pins 35, and then ride over and catch the catch pins 35. A lever not shown is manually operated to disengage the locking levers 34 from the catch pins 35 and thereby unlock the latch.

The first arm 31 and second arm 32 are constantly urged to open by torsion springs 36 and 37. When the latch is unlocked, the springs cause the operating cover 3 to open a certain amount as shown in FIG. 2, thereby making opening the operating cover 3 easy. After the latch is unlocked and the first arm 31 and second arm 32 are opened by the force of the springs, the arms open and close together while held at the open angle therebetween shown in FIG. 2.

A pressure spring 38 that urges the second arm 32 to the closed position is attached to the first arm 31. When the first arm 31 is pressed in the closing direction from the position shown in FIG. 2, this pressure spring 38 contacts the spring receiver 39 rendered to the second arm 32. As a result, the second arm 32 is held in the closed position by the force of the pressure spring 38.

The pressure spring 38 in this embodiment of at least one embodiment of the invention can slide from the position touching the spring receiver 39 to the position indicated by the dotted line in FIG. 2. When the pressure spring 38 is slid, the second arm 32 is not pressed to the closed position by the force of the pressure spring 38 when the first arm 31 is closed, and is held floating in the open position by the force of the torsion spring 37. As a result, the second thermal print head 12 mounted on the second arm 32 is not pressed to the second platen roller 22, and is held in this floating position. Only the front thermo-sensitive surface 6*a* is printed by the first thermal print head 11.

The operational effect of this double-sided thermal printer 1 is described next.

When the operating cover 3 is unlocked and the operating cover 3 is opened from the closed position 3A indicated by the solid line in FIG. 1 to the open position 3B indicated by the double-dot dash line, the first arm 31 attached to the operating cover 3 also opens and the second arm 32 also opens in conjunction therewith. As a result, the top of the roll paper storage compartment 4 is open and the roll paper 5 can be replaced, for example.

When the roll paper 5 is replaced, a specific length of the double-sided thermal paper 6 is pulled from the new roll paper 5 placed in the roll paper storage compartment 4, and the operating cover 3 is closed while tension is held on the thermal paper 6 that was pulled out. When the operating cover 3 is closed, the first and second arms 31 and 32 also close. As shown in FIG. 2, the first and second arms 31 and 32 pivot closed at a specific opening angle. The second thermal print head 12 mounted on the second arm 32 is therefore first pressed against the second platen roller 22 on the printer frame 30 side and the double-sided thermal paper 6 is held between the second thermal print head 12 and second platen roller 22. The first platen roller 21 mounted on the first arm 31 is then pressed against the first thermal print head 11 on the printer frame 30 side, and the double-sided thermal paper 6 is held between the first thermal print head 11 and first platen roller 21.

When the operating cover 3 is thus closed, the double-sided thermal paper 6 is first held between the second thermal print head 12 and second platen roller 22 at an upstream side position, and is then held between the first thermal print head 11 and first platen roller 21 on the downstream side. Therefore, if tension is held on the thermal paper 6 as the operating cover 3 is closed, there will be no slack in the thermal paper 6 between the back-side printing position 8 and the front-side printing position 9. Less time is therefore needed for the paper feed operation used to remove slack in the thermal paper 6 before printing. Problems such as a drop in print quality caused by the thermal paper 6 becoming skewed due to slack therefore do not occur.

It is also only necessary to position the first platen roller 21 mounted on the first arm 31 to the first thermal print head 11 on the printer frame 30 side, and to separately position the second thermal print head 12 mounted on the second arm 32 to the second platen roller 22 on the printer frame 30 side. The parts can therefore be positioned more precisely and positioning is also easier than in a construction having a thermal head and platen roller that require separately positioning to different parts disposed on a single arm.

After the second arm 32 reaches the closed position 32A, the first arm 31 reaches the closed position 31A and the operating cover 3 is locked closed by the latch mechanism. When a single arm is closed to press the first thermal print head to the second platen roller and simultaneously press the second thermal print head to the first platen roller, a large amount of force is applied to lock the arm and the arm can be easily deformed. If the arm becomes deformed, there is a strong possibility that only one of the locking levers 34 disposed to both widthwise sides of the printer will catch the catch pin 35, the other locking lever 34 will not catch the catch pin 35, and the cover will be latched on only one side.

By using two arms, however, the force applied to the first arm 31 increases gradually, strong force is applied only when locking, and at least one embodiment of the invention can therefore avoid latching on only one side.

Another latch mechanism that also locks the second arm 32 in the closed position is rendered between the second thermal print head 12 and the printer frame 30. The force of the pressure spring 38 doesn't apply to the first arm 31 after the second arm 32 is locked.

The paper transportation load can also be reduced and high speed printing enabled when the double-sided thermal printer 1 is used to print on common single-sided thermal paper having a thermo-sensitive surface formed on only one side.

Figure 3:
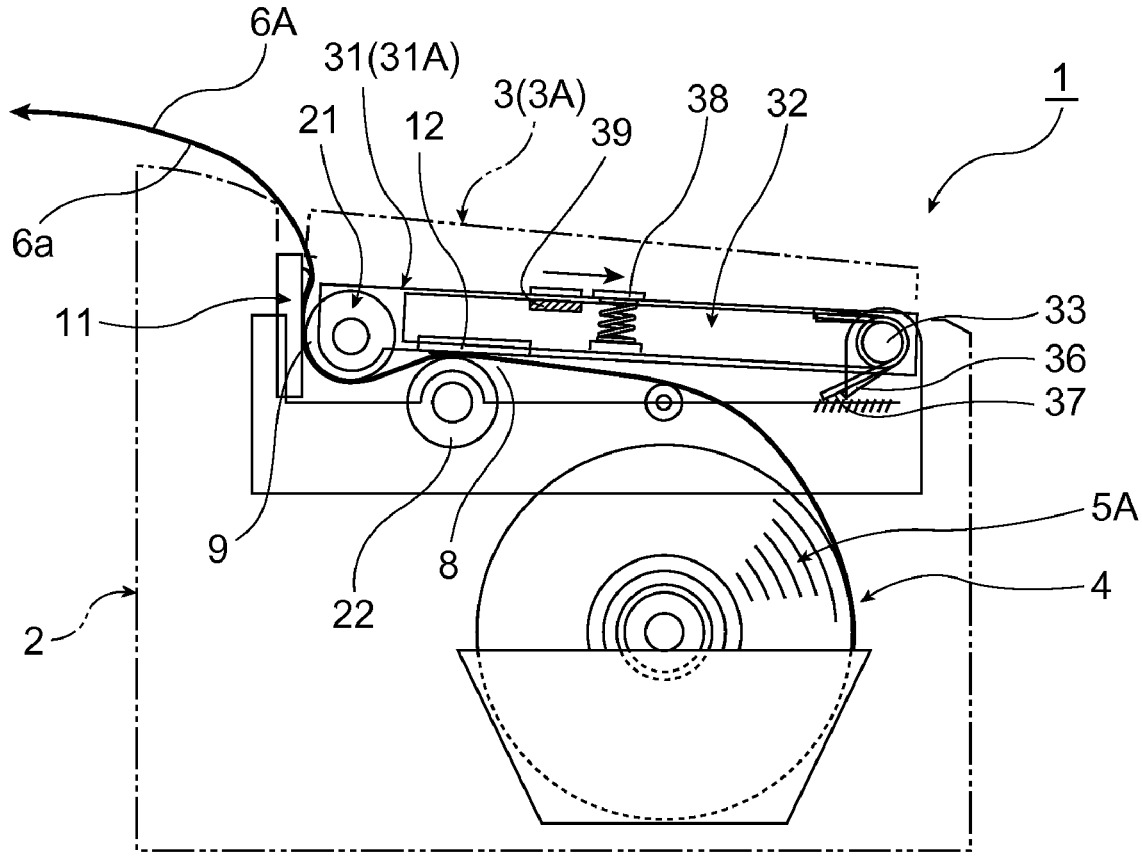
FIG. 3 shows the double-sided thermal printer shown in FIG. 1 in the single-side print mode.

For simplex printing, the pressure spring 38 of the first arm 31 is slid so that it does not contact the spring receiver 39 of the second arm 32 as shown in FIG. 3. When the operating cover 3 is closed after thus sliding the pressure spring 38, the second arm 32 will be urged in the opening direction by the torsion spring 37 even when the first arm 31 is locked in the closed position 31A, and will remain floating without reaching the closed position 32A. As a result, the second thermal print head 12 on the second arm 32 will not be pressed to the second platen roller 22 on the printer frame 30 side, and will be held floating away from the platen.

The single-sided thermal paper 6A pulled from the roll paper 5 is therefore not held between the second thermal print head 12 and the second platen roller 22 at the back-side printing position 8 and is only held between the first thermal print head 11 and first platen roller 21 at the front-side printing position 9. Unnecessary pressure is therefore not applied, and the transportation load on the single-sided thermal paper 6A is lower. The paper transportation motor (not shown in the figure) can also be driven faster than during duplex printing, and high speed printing is possible.

Various means can be used as the mechanism stopping the second arm 32 from closing to the closed position 32A during simplex printing. The second arm 32 could also be closed to the closed position 32A and the second platen roller 22 on the printer frame 30 side could be made to escape. More specifically, the second platen roller 22 could be made to move to a position not in contact with the second thermal print head 12 on the second arm 32 side.

The second arm 32 could also be rendered as a unit that can be installed to and removed from the horizontal shaft 33 on the printer frame 30 side, and the second arm could be removed for simplex printing.

Other Embodiments

Figure 4A:
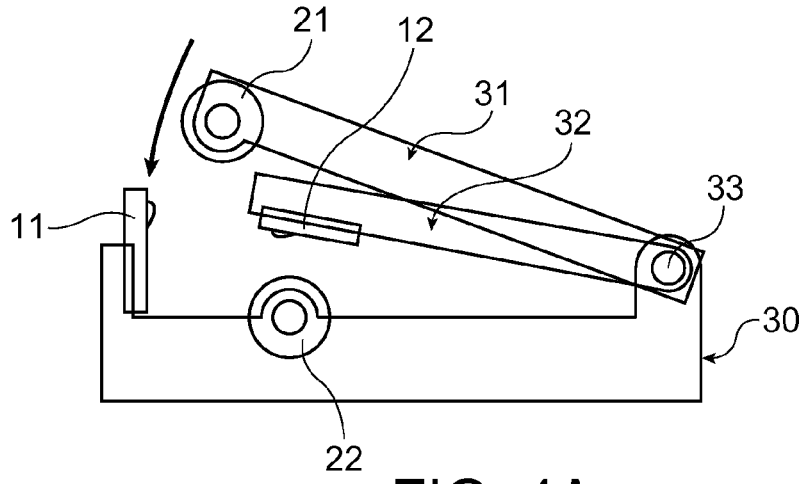
FIG. 4A, FIG. 4B, and FIG. 4C show the first and second arms at different pivot positions.

As shown in FIG. 4A, the first and second arms 31 and 32 in the double-sided thermal printer 1 described above pivot on a common horizontal shaft 33. The first and second arms 31 and 32 can alternatively pivot on different horizontal shafts.

Figure 4B:
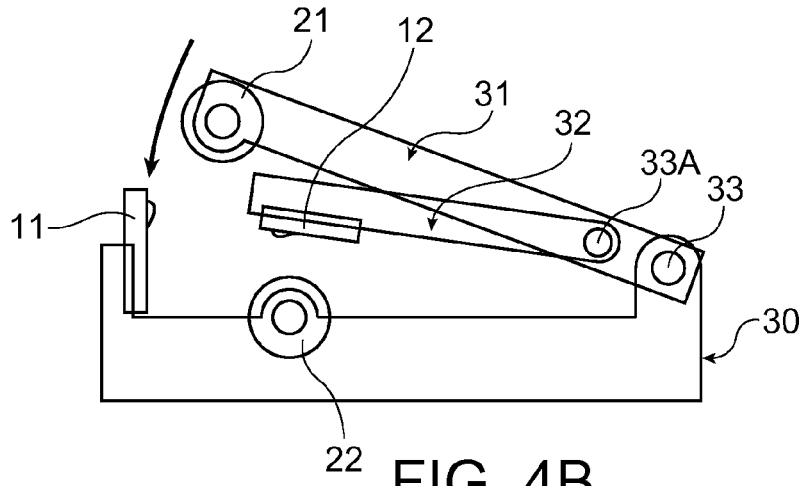

As shown in FIG. 4B, for example, the pivot axis of the first arm 31 can be determined by a horizontal shaft 33 disposed on the printer frame 30 side, and the pivot axis of the second arm 32 can be determined by a horizontal shaft 33A attached to the first arm 31.

Figure 4C:
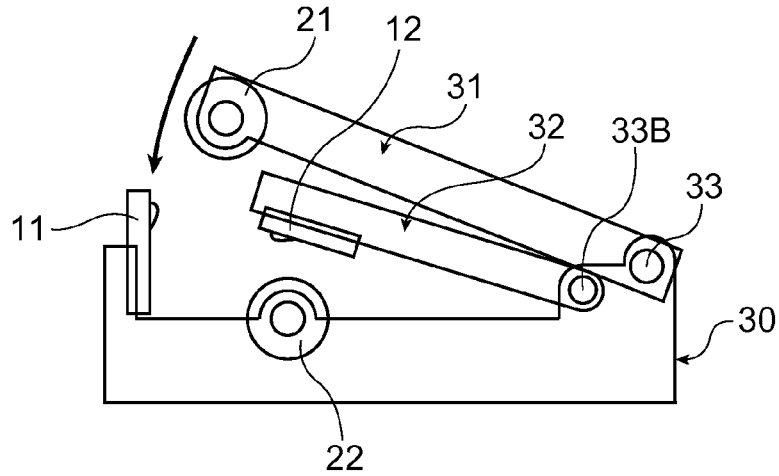

Further alternatively, as show in FIG. 4C, the pivot axis of the first arm 31 can be determined by a horizontal shaft 33 disposed on the printer frame 30 side, and the pivot axis of the second arm 32 can be determined by a separate horizontal shaft 33B also disposed on the printer frame 30 side.

Figure 5:
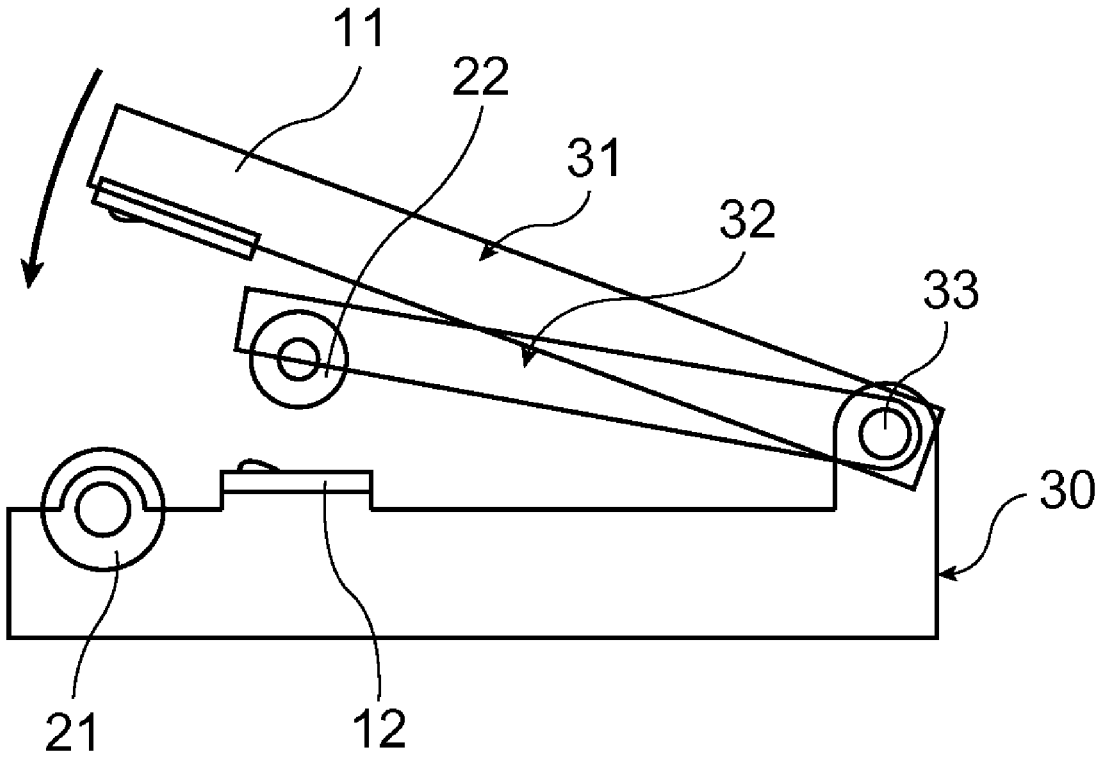
FIG. 5 shows an example in which the thermal print heads and platen rollers are attached at different positions.

As shown in FIG. 5, the first thermal print head 11 could be disposed to the first arm 31 with the first platen roller 21 disposed to the printer frame 30 side. In this configuration the second platen roller 22 is mounted on the second arm 32 side, and the second thermal print head 12 is mounted on the printer frame 30 side.

FIG. 1 to FIG. 3 show the thermal paper 6 being conveyed counterclockwise from the roll paper 5, but the orientation of the roll paper 5 can be reversed and the thermal paper 6 conveyed clockwise.

At least one embodiment of the invention being thus described, it will be obvious that it may be varied in many ways. Such variations are not to be regarded as a departure from the spirit and scope of at least one embodiment of the invention, and all such modifications as would be obvious to one skilled in the art are intended to be included within the scope of the following claims.

What is claimed is:

1. A thermal printer comprising:

a first thermal print head;

a first platen roller;

a second thermal print head;

a second platen roller;

a printer frame on which the first thermal print head and second platen roller are mounted;

a first arm on which the first platen roller is mounted and which can move between a first closed position where the first platen roller is pressed to the first thermal print head, and a first open position where the first platen roller is separated from the first thermal print head; and a second arm on which the second thermal print head is mounted and which can move between a second closed position where the second thermal print head is pressed to the second platen roller and a second open position where the second thermal print head is separated from the second platen roller; and wherein the second arm moves from the second open position to the second closed position when the first arm moves from the first open position to the first closed position; and the second arm moves from the second closed position to the second open position when the first arm moves from the first closed position to the first open position; wherein the second arm reaches the second closed position before the first arm reaches the first closed position when the first arm moves from the first open position to the first closed position.

2. The thermal printer described in claim 1, wherein:

the second platen roller can move to a position where the second platen roller does not contact the second thermal print head.

3. The thermal printer described in claim 1, wherein:

the first arm and the second arm pivot on the same pivot shaft attached to the printer frame.

4. A thermal printer comprising:

a first thermal print head;

a first platen roller;

a second thermal print head;

a second platen roller;

a printer frame on which the first platen roller and second thermal print head are mounted;

a first arm on which the first thermal print head is mounted and which can move between a first closed position where the first thermal print head is pressed to the first platen roller, and a first open position where the first thermal print head is separated from the first platen roller; and a second arm on which the second platen roller is mounted and which can move between a second closed position where the second platen roller is pressed to the second thermal print head and a second open position where the second platen roller is separated from the second thermal print head; and wherein the second arm moves from the second open position to the second closed position when the first arm moves from the first open position to the first closed position; and the second arm moves from the second closed position to the second open position when the first arm moves from the first closed position to the first open position; wherein the second arm reaches the second closed position before the first arm reaches the first closed position when the first arm moves from the first open position to the first closed position.

5. The thermal printer described in claim 4, wherein:

the second platen roller can move to a position where the second platen roller does not contact the second thermal print head.

6. The thermal printer described in claim 4, wherein:

the first arm and the second arm pivot on the same pivot shaft attached to the printer frame.

7. A thermal printer comprising:

a first thermal print head;

a first platen roller;

a second thermal print head;

a second platen roller;

a printer frame on which the first thermal print head and second platen roller are mounted;

a first arm on which the first platen roller is mounted and which can move between a first closed position where the first platen roller is pressed to the first thermal print head, and a first open position where the first platen roller is separated from the first thermal print head; and a second arm on which the second thermal print head is mounted and which can move between a second closed position where the second thermal print head is pressed to the second platen roller and a second open position where the second thermal print head is separated from the second platen roller; and wherein the second arm moves from the second open position to the second closed position when the first arm moves from the first open position to the first closed position; and the second arm moves from the second closed position to the second open position when the first arm moves from the first closed position to the first open position; wherein the first arm pivots on a first pivot shaft attached to the printer frame; and the second arm pivots on a second pivot shaft that is attached parallel to the first pivot shaft on the printer frame at a position that is different from the first pivot shaft.

8. A thermal printer comprising:

a first thermal print head;

a first platen roller;

a second thermal print head;

a second platen roller;

a printer frame on which the first thermal print head and second platen roller are mounted;

a first arm on which the first platen roller is mounted and which can move between a first closed position where the first platen roller is pressed to the first thermal print head, and a first open position where the first platen roller is separated from the first thermal print head; and a second arm on which the second thermal print head is mounted and which can move between a second closed position where the second thermal print head is pressed to the second platen roller and a second open position where the second thermal print head is separated from the second platen roller; and wherein the second arm moves from the second open position to the second closed position when the first arm moves from the first open position to the first closed position; and the second arm moves from the second closed position to the second open position when the first arm moves from the first closed position to the first open position; wherein the first arm pivots on a first pivot shaft attached to the printer frame; and the second arm pivots on a second pivot shaft attached to the first arm parallel to the first pivot shaft.

9. A thermal printer comprising:

a first thermal print head;

a first platen roller;

a second thermal print head;

a second platen roller;

a printer frame on which the first platen roller and second thermal print head are mounted;

a first arm on which the first thermal print head is mounted and which can move between a first closed position where the first thermal print head is pressed to the first platen roller, and a first open position where the first thermal print head is separated from the first platen roller; and a second arm on which the second platen roller is mounted and which can move between a second closed position where the second platen roller is pressed to the second thermal print head and a second open position where the second platen roller is separated from the second thermal print head; and wherein the second arm moves from the second open position to the second closed position when the first arm moves from the first open position to the first closed position; and the second arm moves from the second closed position to the second open position when the first arm moves from the first closed position to the first open position; wherein the first arm pivots on a first pivot shaft attached to the printer frame; and the second arm pivots on a second pivot shaft that is attached parallel to the first pivot shaft on the printer frame at a position that is different from the first pivot shaft.

10. A thermal printer comprising:

a first thermal print head;

a first platen roller;

a second thermal print head;

a second platen roller;

a printer frame on which the first thermal print head and second platen roller are mounted;

a first arm on which the first platen roller is mounted and which can move between a first closed position where the first platen roller is pressed to the first thermal print head, and a first open position where the first platen roller is separated from the first thermal print head; and a second arm on which the second thermal print head is mounted and which can move between a second closed position where the second thermal print head is pressed to the second platen roller and a second open position where the second thermal print head is separated from the second platen roller; and wherein the second arm can be set to a position not reaching the second closed position regardless of the position of the first arm.

11. A thermal printer comprising:

a first thermal print head;

a first platen roller;

a second thermal print head;

a second platen roller;

a printer frame on which the first platen roller and second thermal print head are mounted;

a first arm on which the first thermal print head is mounted and which can move between a first closed position where the first thermal print head is pressed to the first platen roller, and a first open position where the first thermal print head is separated from the first platen roller; and a second arm on which the second platen roller is mounted and which can move between a second closed position where the second platen roller is pressed to the second thermal print head and a second open position where the second platen roller is separated from the second thermal print head; and wherein the second arm can be set to a position not reaching the second closed position regardless of the position of the first arm.

* * * * *